United States Patent [19]

Erickson

[11] Patent Number: 4,727,988

[45] Date of Patent: Mar. 1, 1988

[54] FOLDED ENVELOPE AND BLANK FOR FORMING SAME

[76] Inventor: Joyce M. Erickson, 1324 Hillcrest Dr., Fredrick, Md. 21701

[21] Appl. No.: 815,553

[22] Filed: Jan. 2, 1986

[51] Int. Cl.[4] ..... B65D 27/06; B65D 27/34; B65D 27/38

[52] U.S. Cl. ..... 206/610; 229/73; 229/84; 229/92.7

[58] Field of Search ..... 229/73, 92.7, 81, 82, 229/84; 206/610

[56] References Cited

U.S. PATENT DOCUMENTS

| | | | |
|---|---|---|---|
| 38,755 | 6/1863 | Murphy | 229/92.7 |
| 696,431 | 4/1902 | Hammond et al. | 229/84 |
| 957,172 | 5/1910 | Maren-Covick | 229/82 |
| 1,952,972 | 3/1934 | Councilor | 229/92.7 |
| 1,965,389 | 7/1934 | Parr | 229/92.7 |
| 2,137,516 | 11/1938 | West | 229/92.7 |
| 3,018,033 | 1/1962 | Henry | 229/73 |
| 3,711,012 | 1/1973 | Cytron et al. | 229/73 |
| 3,995,808 | 12/1976 | Kehoe | 229/92.7 |

*Primary Examiner*—Stephen P. Garbe
*Attorney, Agent, or Firm*—Daniel E. McConnell

[57] ABSTRACT

A suitably cut and scored blank adapted to be folded for forming a folded envelope and an envelope formed therefrom. The blank and envelope are formed from a sheet of foldable material such as paper cut and scored for defining a planar rectangular main body of predetermined height and width and bounded by three straight side score lines and a cut edge and have at least one vertical score line dividing the main body into at least two body portions of substantially equal height which are hingedly connected one to the other along the vertical score line. Right and left flap panels extend vertically of the main body and are hingedly connected along right and left side score lines for folding leftwardly and rightwardly respectively into juxtaposition with the body portions. A closure flap panel of predetermined height extends horizontally of and substantially coextensively with the main body and is hingedly connected to an adjacent body portion along the one side score line remote from and parallel to said cut edge. Perforations extending parallel to the one side score line and crossing the closure flap panel at a predetermined distance therefrom facilitate separation of said closure flap panel into a reclosable flap portion which may be inserted into a linear cut line on reuse of the envelope and a reinforcing strip portion.

18 Claims, 32 Drawing Figures

FOLDED ENVELOPE AND BLANK FOR FORMING SAME

FIELD AND BACKGROUND OF INVENTION

This invention relates to a folded envelope and a blank for forming the same. The folded envelope of this invention provides a simple folder-envelope in which items may be categorized for mailing and which may be re-closed after an initial opening for use as a filing folder or the like.

Folded envelopes of various types have been widely proposed and used before. Specific examples may be found in prior U.S. Pat. Nos. 1,473,329; 1,586,016; 1,677,022; 1,682,167; and 2,859,907 as well as in the catalogs and publications of various stationery trade businesses. While such envelopes have been proposed, and some types may have achieved some usefulness, none are known to provide the particular combination of sealable and reclosable folder features to be found in the blank and envelope of the present invention.

BRIEF DESCRIPTION OF INVENTION

The present invention contemplates that the blank of this invention may be easily handled by presently conventional printing presses, die cutting machines, folding machines and inserters to accomplish a simple, flexible format constructed from a flat sheet such as paper which is easily imprinted by a single press pass if desired, die cut, folded, assembled with loose materials such as brochures or the like to be contained, sealed and mailed. After receipt, the envelope may be opened and thereafter function as a folder to retain the loose materials.

Accordingly, it is an object of this invention to provide a blank which is easily handled using conventional equipment and which accomplishes the multiple functions of receiving and containing loose materials such as brochures for mailing and later retention of such materials after an initial opening. In realizing this object of the invention, organizations having needs for circulating collated yet unbound materials of the types referred to are given an opportunity to easily and economically achieve an orderly and pleasing display of the materials as received while also providing recipients with a longer term storage folder for the materials. Persons who have attended conventions and training sessions of various sorts will immediately recognize the advantages of such a folder-envelope, as will those who must organize such meetings.

Yet a further object of the present invention is to provide a distinctive envelope capable of both containing loose materials for mailing and serving as a folder for retaining such materials during use or storage.

BRIEF DESCRIPTION OF DRAWINGS

Some of the objects of the invention having been stated, other objects will appear as the description proceeds, when taken in connection with the accompanying drawings, in which:

FIGS. 27 through 32 are a series of views generally similar to FIGS. 1 through 6 showing a form of the blank and envelope of the present invention particularly adapted for use as a re-transmittál envelope.

DETAILED DESCRIPTION OF INVENTION

Figure 1:
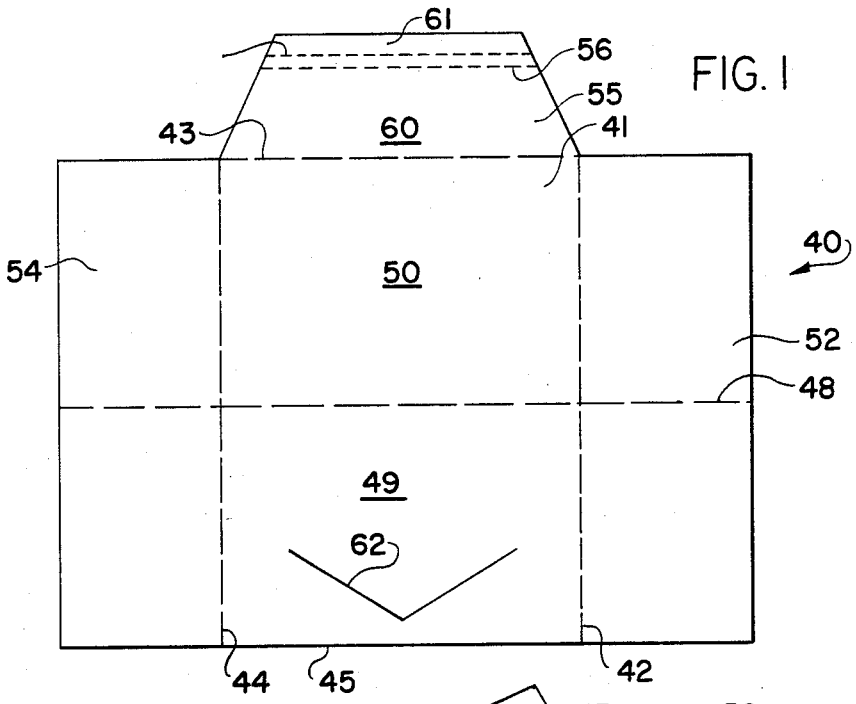
FIG. 1 is a plan view of a blank for a first form of the envelope of the present invention.

While the present invention will be described more fully hereinafter with reference to the accompanying drawings, in which a preferred embodiment of the present invention is shown, it is to be understood at the outset of the description which follows that persons of skill in the appropriate arts may modify the invention here described while still achieving the favorable results of this invention. Accordingly, the description which follows is to be understood as being a broad, teaching disclosure directed to persons of skill in the appropriate arts, and not as limiting upon the present invention.

Referring now more particularly to the drawings, the present invention will first be described with reference to a preferred form, and then modified forms will be described. Common reference characters will be used for common elements as described hereinafter.

The preferred form of a blank in accordance with this invention is shown in FIG. 1, where the blank is indicated generally at 40. The blank is formed from any suitable sheet material which may be printed, scored, cut and folded as required to form an envelope as hereinafter described. A preferred sheet material is paper, while others which may be used will be known the person skilled in the arts of manufacturing envelopes and the like.

The blank 40 has a planar, rectangular main body portion 41 of predetermined height and width. In FIG. 1, the dimension here referred to as the height of the main body portion 41 extends vertically, while the dimension referred to as the width extends horizontally. In the form here referred to, the main body portion is bounded by three straight side score lines 42, 43, 44 and a cut edge 45. There is a horizontal score line 48 which crosses the main body portion 41 and divides the main body portion into two body portions 49, 50 of substantially equal width which are hingedly connected one to the other along the horizontal score line 48.

Figure 2:
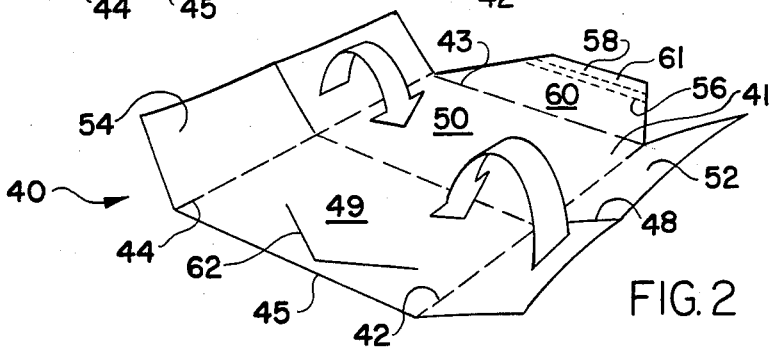
FIG. 2 is a perspective view of the blank of FIG. 1 being folded in a first step in the process of preparing the envelope for transmittal.
Figure 3:
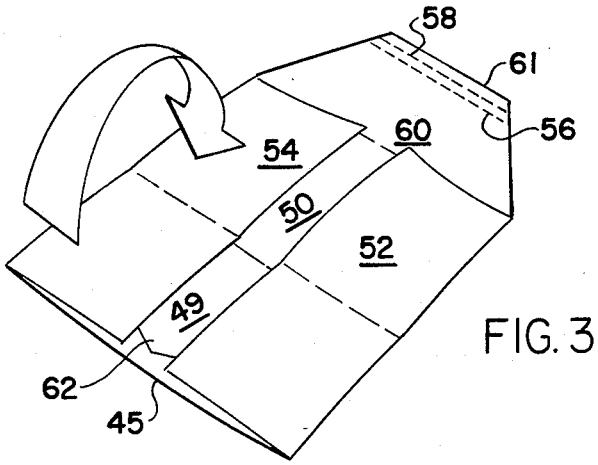
FIG. 3 is a view similar to FIG. 2 showing the blank of FIG. 1 being folded in a second step in the process of preparing the envelope for transmittal.
Figure 4:
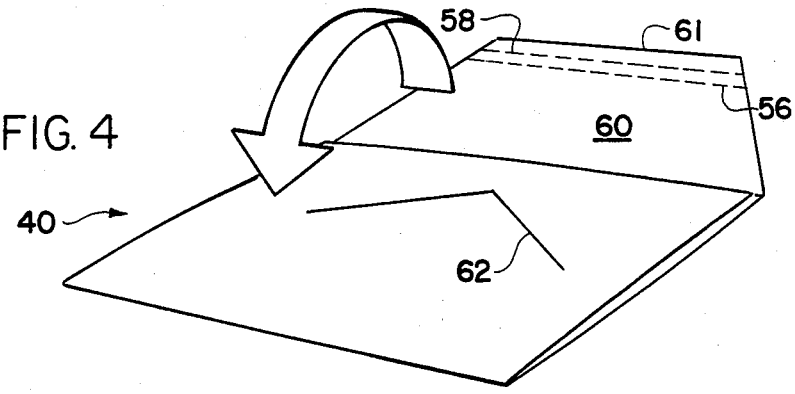
FIG. 4 is a view similar to FIGS. 2 and 3 showing the blank of FIG. 1 being folded for sealing for transmittal.

In accordance with features of this invention to which greater attention will be given hereinafter, right and left side flap panel means 52, 54 are provided extending vertically of the main body portion 41 and hingedly connected thereto along right and left side score lines 42, 44 for folding leftward and rightward respectively (FIG. 2) into juxtaposition with the body portions 49, 50. The flap panel means may take various forms in variations of the present invention, some of which will be more particularly described hereinafter. Their cooperation with other elements of the blank and the envelope formed from the blank imparts to the present invention several of its distinctive characteristics. As will become more clear hereinafter, the flap panels are contemplated as serving the functions of retaining loose materials such as brochures and sheet inserted into the envelope contemplated by this invention, both while mailing such materials and during storage and use of the materials after an initial opening of the envelope.

In order to accommodate mailing and subsequent reuse of the envelope to be formed from the blank, the blank 41 has a closure flap panel 55 of predetermined width extending horizontally of and substantially coextensively with the main body and hingedly connected to the adjacent body portion 50 along the one of said side score lines 43 which is remote from and parallel to the cut edge 45. The closure flap 55 preferably is generally trapezoidal in configuration and is crossed by at least one line 56, and preferably two lines 56, 58, of perforations extending parallel to the one side score line 43 and crossing said closure flap panel at a predetermined distance therefrom for facilitating separation of the closure flap panel 55 into a reclosable flap portion 60 and a reinforcing strip portion 61. As pointed out more fully hereinafter, the line(s) of perforations cross the entirety of the flap and thus are of a predetermined length.

In order to accommodate reclosure of the envelope produced from the blank of this invention, and thus to realize certain objectives of this invention, a linear cut line 62 is formed in and extends generally vertically of a body portion 49 remote from the closure flap panel 55 and adjacent to the one body portion 50 to which the closure flap panel 55 is connected. The cut line 62 is of such a predetermined length and so positioned relative to the horizontal score line 48 as to be spaced therefrom at a distance which, when added to the distance at which the perforation line 56 is spaced from the adjacent side score line 43, is substantially the same as the width of one of the body portions 49, 50.

Figure 5:
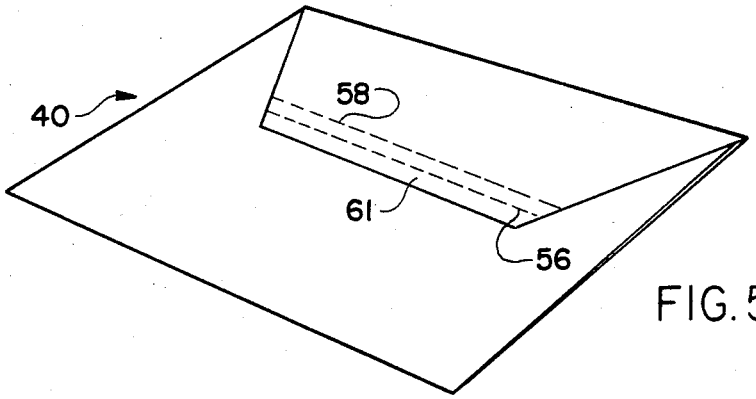
FIG. 5 is a view similar to FIGS. 2 through 4 showing the blank of FIG. 1 as folded and sealed for use as a transmitting envelope.
Figure 6:
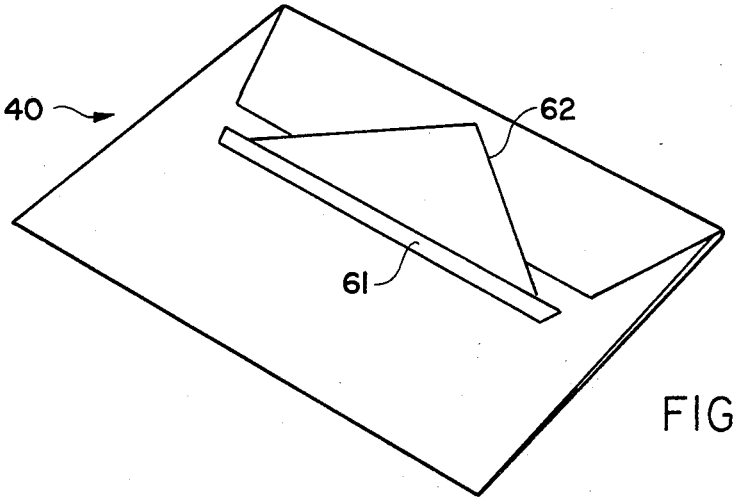
FIG. 6 is a view similar to FIG. 5 showing the envelope as reclosed after opening.
Figure 7:
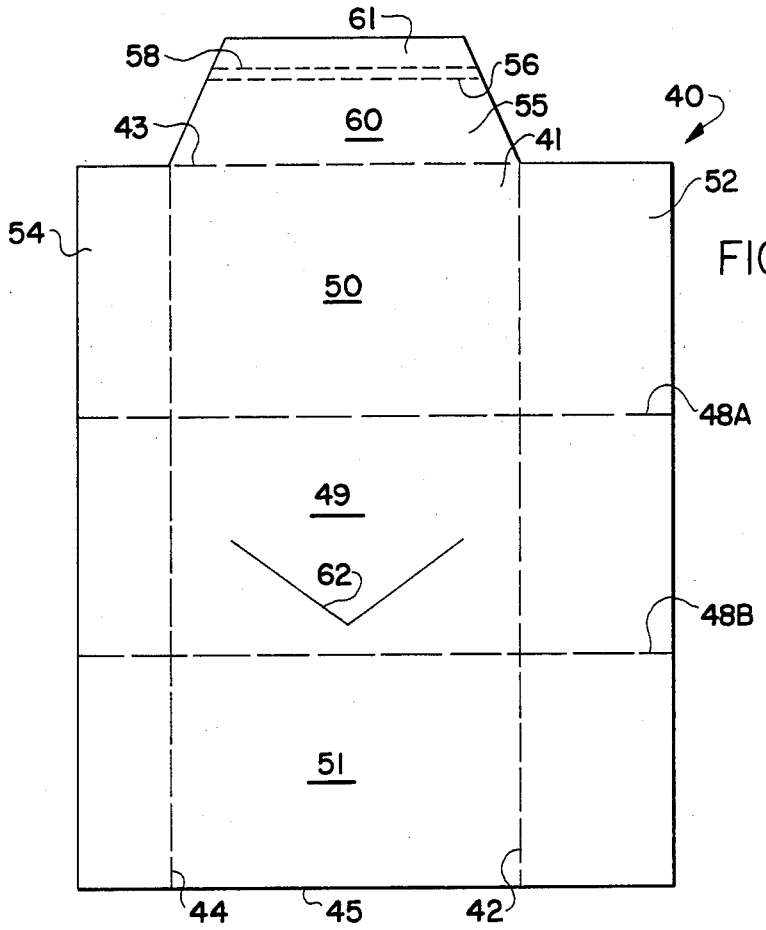
FIGS. 7 through 13 are a series of views generally similar to FIGS. 1 through 6 and showing a second form of the blank and envelope of the present invention.
Figure 8:
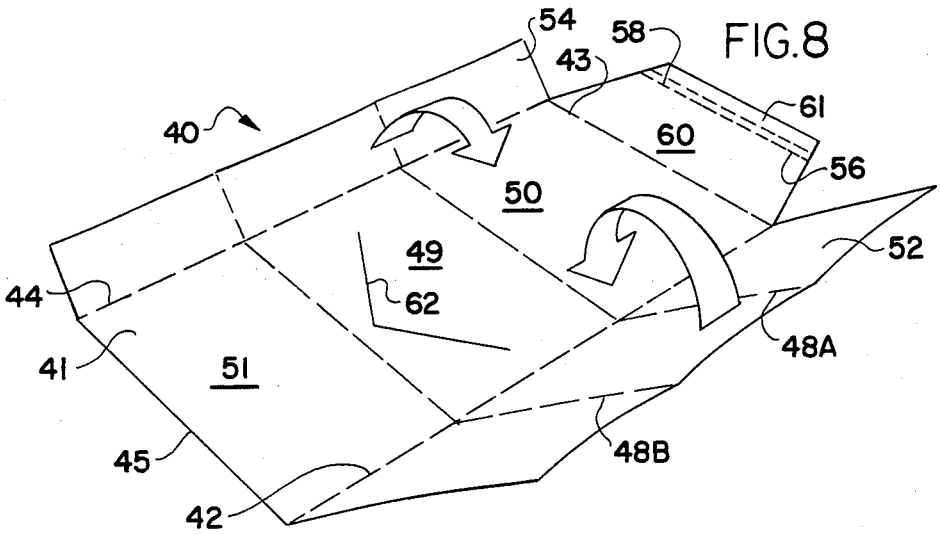
Figure 9:
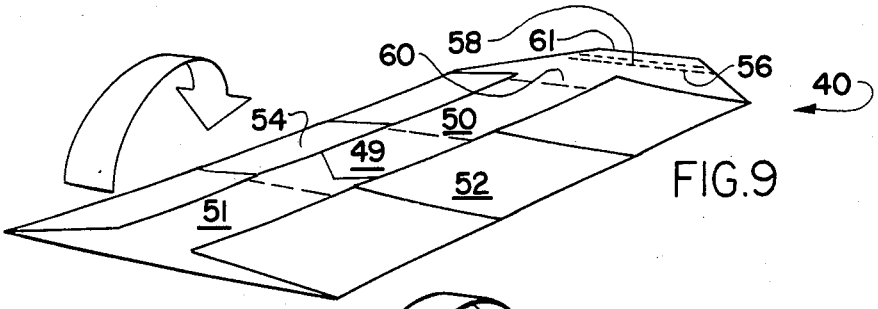
Figure 10:
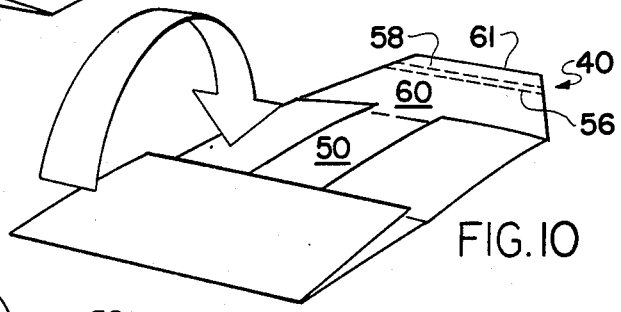
Figure 11:
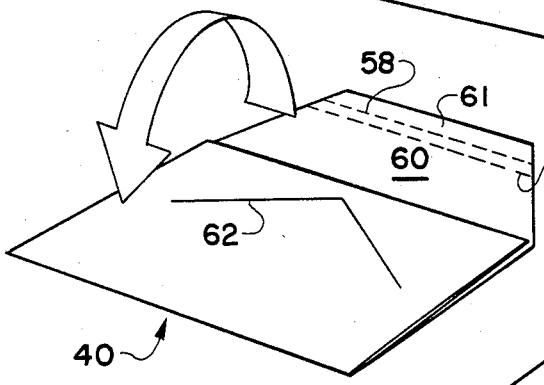
Figure 12:
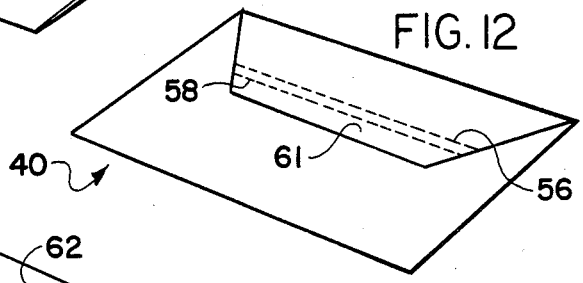
Figure 13:
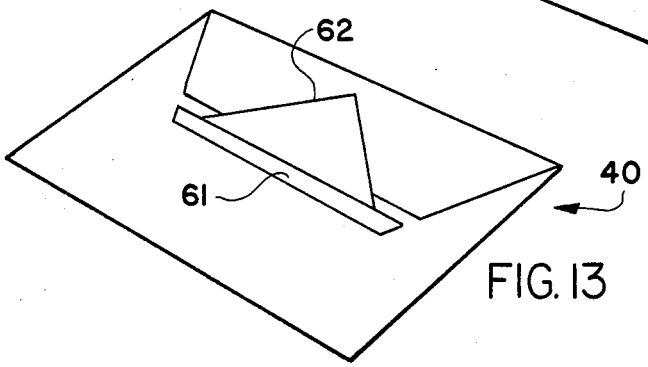
Figure 14:
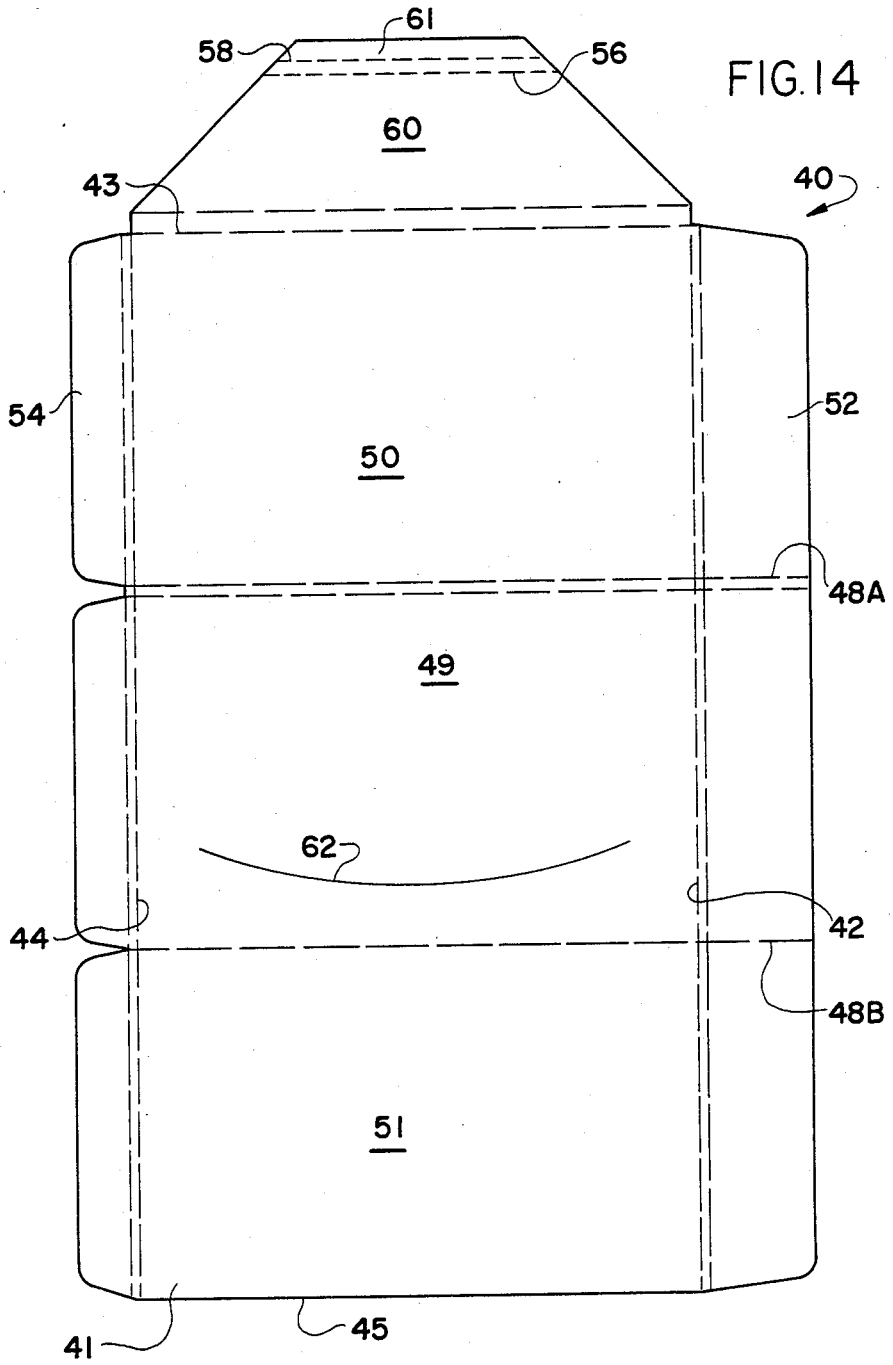
FIGS. 14 through 20 are a series of views generally similar to FIGS. 7 through 13 and showing another form of the blank and envelope of this invention.
Figure 15:
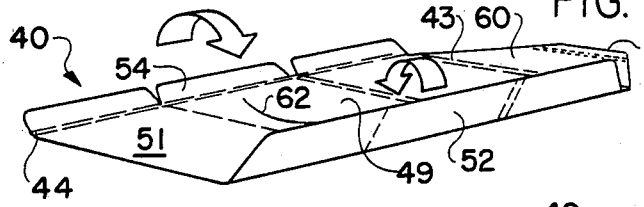
Figure 16:
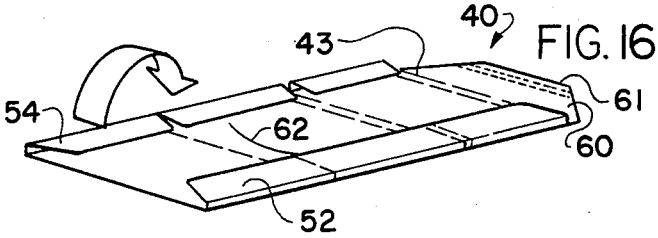
Figure 17:
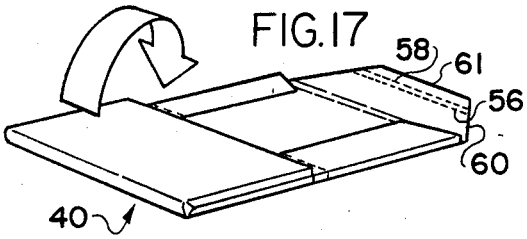
Figure 18:
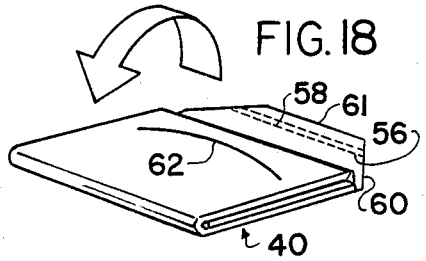
Figure 19:
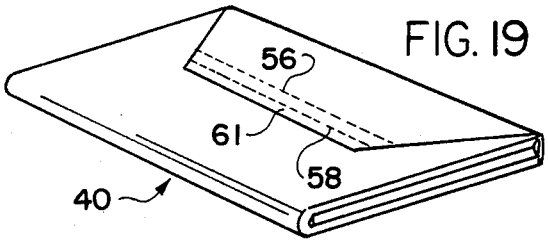
Figure 20:
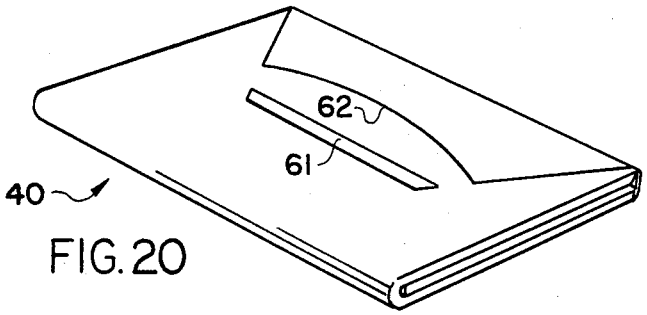
Figure 21:
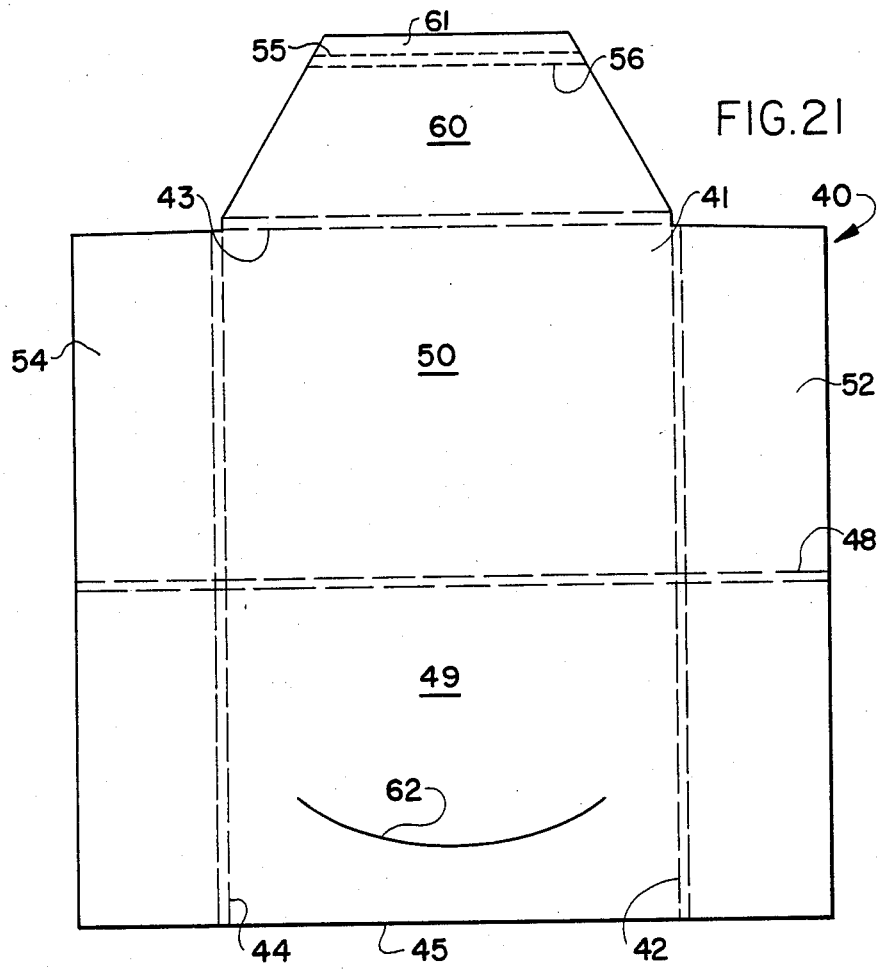
FIGS. 21 through 26 are a series of views generally similar to FIGS. 1 through 6 showing yet another form of the blank and envelope of the present invention.
Figure 22:
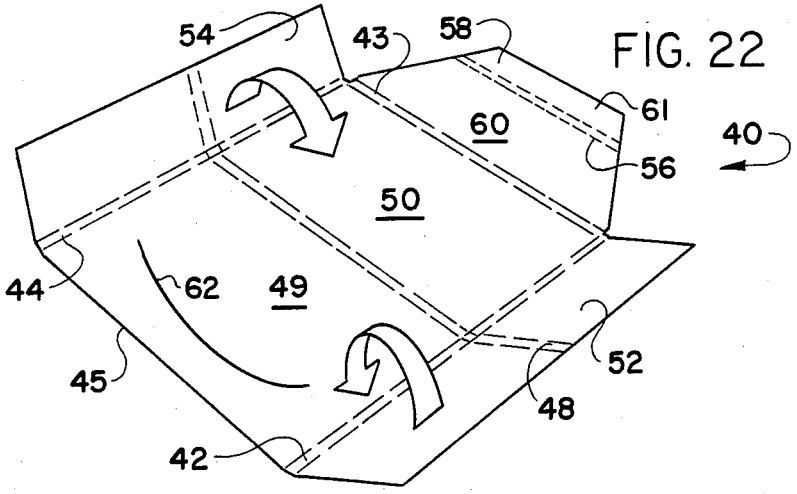
Figures 23, 24, 25, 26:
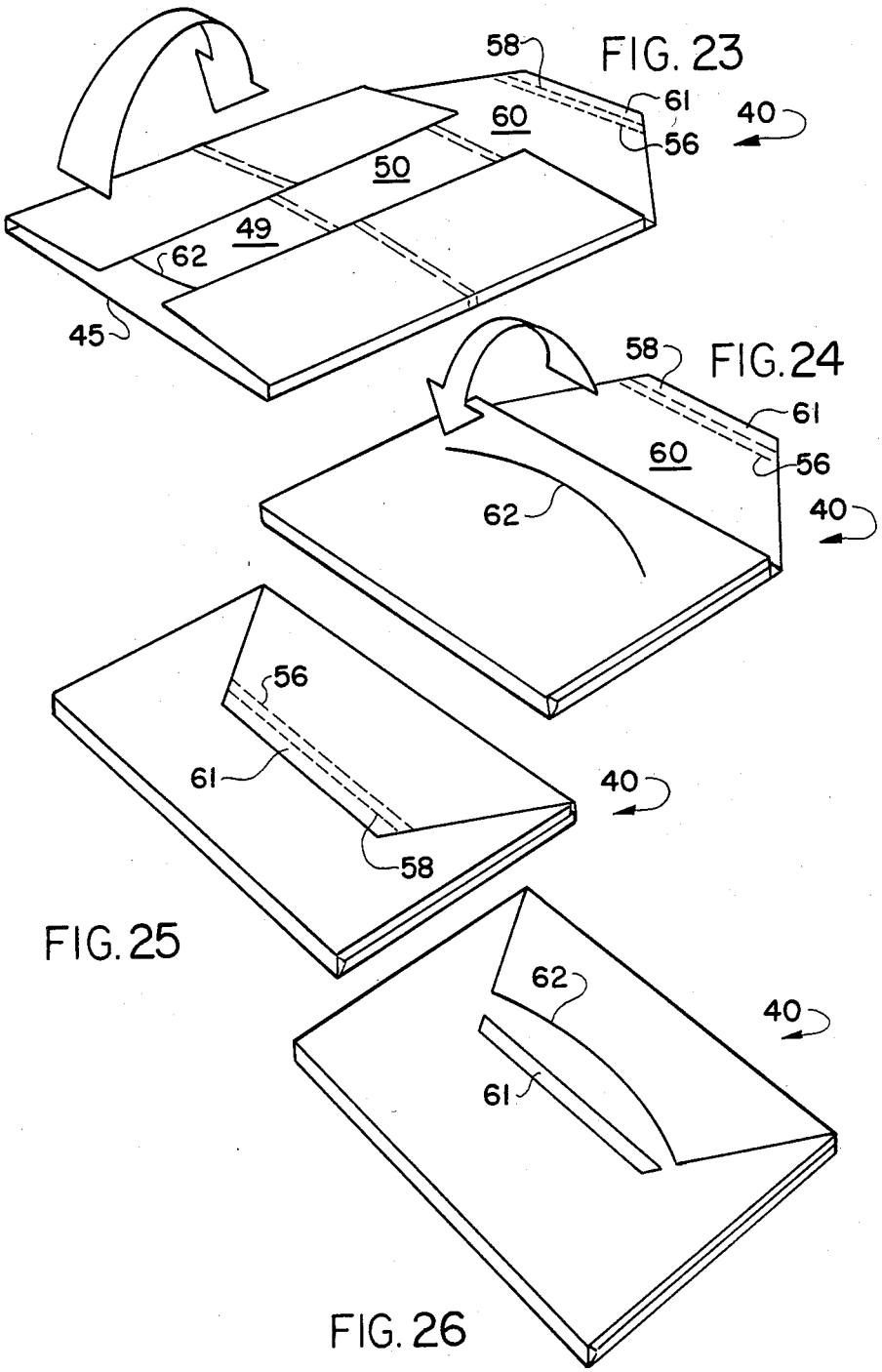
Figure 27:
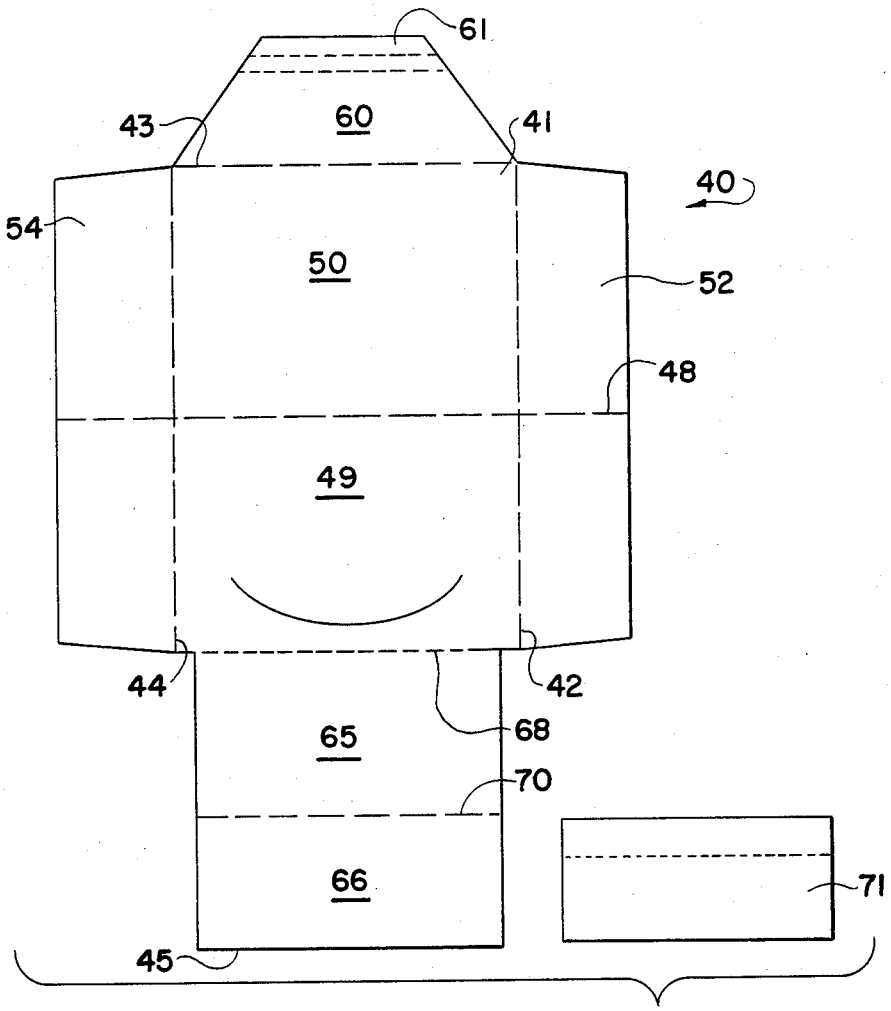
Figures 2, 29, 30, 31, 32:
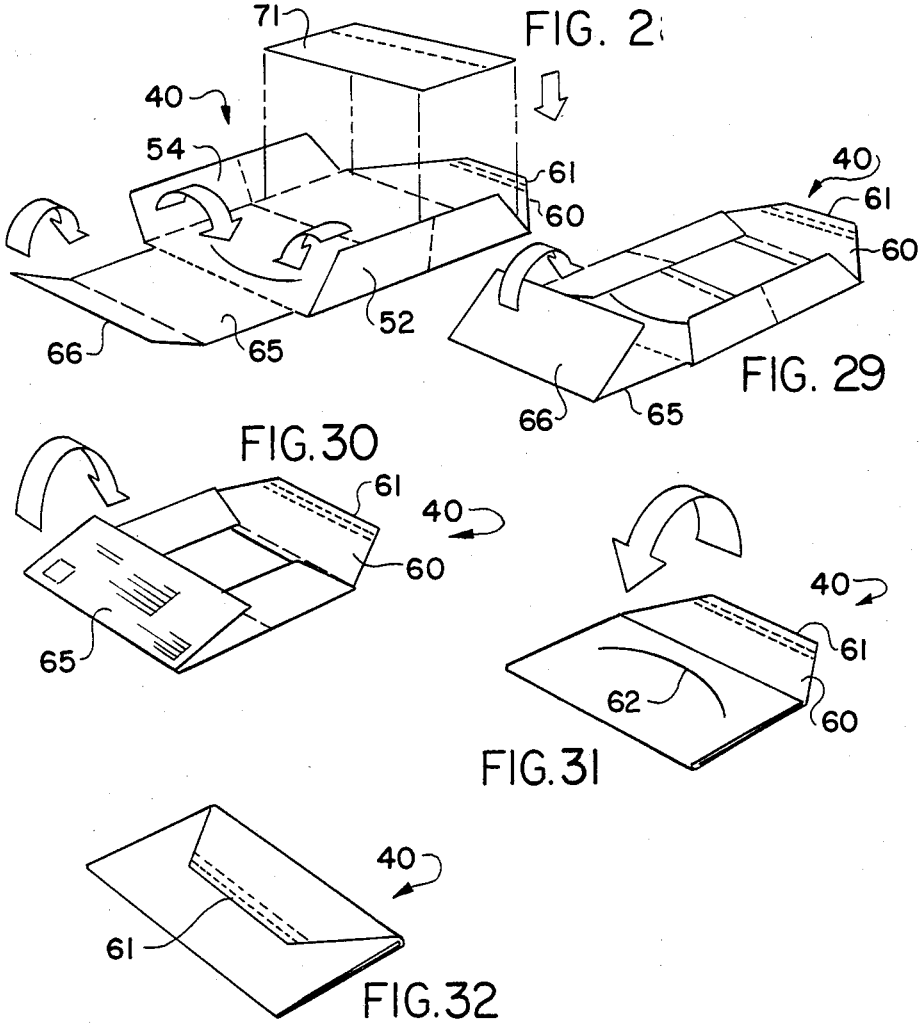

While described to this point with reference to the blank, certain of the features of this invention will become more clear from a discussion of the use of the blank as a folding envelope. More particularly, when formed and folded as generally described hereinabove and as illustrated by the sequence of views found in FIGS. 3 through 6, the envelope thus produced has the capability of receiving loose materials such as brochures, flyers, printed sheets and the like within the pockets formed by the right and left flap means 52, 54 and the body portions 49, 50. The material is retained during mailing by securing the closure flap 55 to the outer surface of the body portion 49 which is to the other side of the central score line 48 (FIG. 5). The relative dimensions of the body, closure flap and cut line are such that the reinforcing strip portion 61 overlies a portion of the cut line 62. The envelope may be opened by separating the perforations, leaving the reinforcing strip to protect the material of the envelope against a tearing extension of the cut line 62 during subsequent reuse. The envelope may then be reused for storage or retention of the materials by tucking the flap 60 into the cut 62 (FIG. 6).

As will be appreciated by persons skilled in the printing arts, the folding envelope of this invention may be easily printed both on surfaces which will appear externally during use and on the surfaces of the flap portions 52, 54 during a single pass through a press. Further, the score lines may be similarly formed during continuous web handling of the material, and may be formed of multiple parallel lines where needed to accommodate greater bulk of materials within the envelope. The last mentioned modification is shown more clearly in the forms of the invention illustrated in FIGS. 14 through 26.

The flap means 52, 54 may be configured in a number of varying ways while realizing the advantages of this invention. One variation will have flap panel means of predetermined widths such that the sum of such widths is greater than the width of said main body. In such an envelope, the flaps may be secured together, such as by gluing, if desired in order to provide even further enhanced security for materials contained therewithin for mailing. Further, the edge configurations of the flaps may be varied in order to impart desired design features (as in FIGS. 7 through 13), or the flaps may be punched to retain papers by prong clips or the like. If desired, stiffening sheets may be inserted into the pockets formed by the folded flap means, either to provide greater body to the finished product or the provide greater security in transmitting enclosures.

Similarly, the cut line 62 may be formed in a number of varying ways. The line may be arcuate, formed as a single arcuate line concave toward the dividing score line 48 (as shown in FIGS. 14 through 32). It may be formed (as shown in FIGS. 1 through 13) as two straight line portions converging away from the score line and intersecting at a point which is medial the width of the body portion 49 in which the cut line is formed. In any case, it preferably extends from and joins a right terminal point and a left terminal point, with the terminal points being spaced from adjacent ones of said side score lines at predetermined equal distances such that the dimension between the terminal points is substantially equal to the length of the line of perforations and thus of the free edge of the reclosable flap after tearing of the perforations. The terminal points may be formed as punched holes of small diameter.

A modified form of blank in accordance with the present invention is shown in FIGS. 7 through 13, where similar reference characters to those used heretofore have been applied to similar elements. The discussion here given will be directed only to the distinctions between the forms, and it will be noted that at least two dividing score lines 48A and 48B cross the main body and define at least three body portions 49, 50, 51 of substantially equal height which are hingedly connected one to the other along those horizontal score lines. This form of the invention is essentially a trifold folder.

The form of FIGS. 14 through 20 is also a trifold folder, having an arcuate cut re-folding cut line and doubled score lines to accomodate greater amounts of retained materials.

The form of FIGS. 21 through 26 is essentially similar to that of FIGS. 1 through 6 and has an arcuate cut line and doubled score lines. The width of the side flaps has been increased in order to increase the security of enclosed materials.

Another modified form is shown in FIGS. 27 through 32 where the main body 41 further comprises a return envelope face panel 65 and a return envelope back panel 66 formed integrally with the main body and interposed between the cut edge 45 and the dividing score line 48. In this form, the face panel 65 is joined to the main body at a separation line 68 which is parallel to the adjacent score line 48 and spaced therefrom with the cut line 62 interposed between the adjacent score line 48 and the separation line 68. The back panel is joined to said face panel at an envelope fold line 70 parallel to the separation line 68. The back and face panels together form a return envelope which may be separated from the remainder of the folding envelope and used for a return mailing, if desired, such as for an enclosed statement form 71. As will be appreciated, the return envelope may, as has been described hereinabove, be printed and formed with the remainder of the blank and envelope essentially in a single press pass.

In the drawings and specifications there has been set forth a preferred embodiment of the invention and, although specific terms are used, the description thus given uses terminology in a generic and descriptive sense only and not for purposes of limitation.

What is claimed is:

1. A suitably cut and scored blank adapted to be folded for forming a folded envelope and comprising a sheet of foldable material such as paper cut and scored for defining a planar rectangular main body of predetermined height and width and bounded by three straight side score lines and a cut edge; at least one dividing score line crossing said main body for dividing said main body into at least two body portions of substantially equal height which are hingedly connected one to the other along said score line; right and left flap panel means extending vertically of said main body and hingedly connected thereto along right and left ones of said side score lines for folding leftwardly and rightwardly respectively into juxtaposition with said body portions; a closure flap panel of predetermined height extending horizontally of and substantially coextensively with said main body and hingedly connected to an adjacent one of said body portions along the one of said side score lines remote from and parallel to said cut edge; at least one line of perforations extending parallel to said one side score line and crossing said closure flap panel at a predetermined distance from said one side score line for facilitating separation of said closure flap panel into a reclosable flap portion and a reinforcing strip portion, said line of perforations being of a predetermined length; and a linear cut line formed in and extending generally horizontally of a body portion remote from said closure flap panel and adjacent to said one body portion to which said closure flap panel is connected, said cut line being of such a predetermined length and so positioned relative to said dividing score line as to have the majority thereof spaced from said dividing score line at distances which, when added to the distance at which said perforation line is spaced from said side score line, is equal to or greater than the height of one of said body portions.

2. A blank as claimed in claim 1 wherein said cut line comprises two straight line portions converging away from said dividing score line and intersecting at a point which is medial the width of the body portion in which the cut line is formed.

3. A blank as claimed in claim 1 wherein said cut line comprises a single arcuate line concave toward said dividing score line.

4. A blank as claimed in claim 1 wherein said cut line extends from and joins a right terminal point and a left terminal point, said terminal points being spaced from adjacent ones of said side score lines at predetermined equal distances such that the width dimension between the terminal points is substantially equal to the length of said line of perforations.

5. A blank as claimed in claim 1 further comprising two parallel lines of perforations formed in and crossing said closure flap for defining therebetween a removable zip tab portion.

6. A blank as claimed in claim 1 wherein said right and left flap panel means have predetermined widths such that the sum of such widths is greater than the width of said main body.

7. A blank as claimed in claim 1 wherein at least two dividing score lines cross said main body and define at least three body portions of substantially equal height which are hingedly connected one to the other along said dividing score lines.

8. A blank as claimed in claim 1 further comprising a return envelope face panel and a return envelope back panel formed integrally with said main body and interposed between said cut edge and an adjacent dividing score line, said face panel being joined to said main body at a separation line which is parallel to said adjacent dividing score line and spaced therefrom with said cut line interposed between said adjacent dividing score line and said separation line, and said back panel being joined to said face panel at an envelope fold line parallel to said separation line.

9. A suitably cut and scored blank adapted to be folded for forming a folded envelope and comprising a sheet of foldable material such as paper cut and scored for defining a planar rectangular main body of predetermined height and width and bounded by three straight side score lines and a cut edge; a horizontal dividing score line crossing said main body for dividing said main body into two body portions of substantially equal width which are hingedly connected one to the other along said dividing score line; right and left flap panel means extending vertically of said main body and hingedly connected thereto along right and left ones of said side score lines for folding leftwardly and rightwardly respectively into juxtaposition with said body portions; a generally trapezoidal closure flap panel of predetermined height extending horizontally of and substantially coextensively with said main body and hingedly connected to an adjacent one of said body portions along the one of said side score lines remote from and parallel to said cut edge; two lines of perforations extending parallel to said one side score line and crossing said closure flap panel at predetermined distances from said one side score line for facilitating separation of said closure flap panel into a reclosable flap portion and a reinforcing strip portion, said lines of perforations being of predetermined length; and a linear cut line formed in and extending generally horizontally of a body portion remote from said closure flap panel and adjacent to said one body portion to which said closure flap panel is connected, said cut line extending from and joining a right terminal point and a left terminal point, said terminal points being spaced from adjacent ones of said side score lines at predetermined equal distances such that the width dimension between the terminal points is substantially equal to the lengths of said lines of perforations, and said cut line being so positioned relative to said dividing score line as to have a major portion of the length thereof spaced from said dividing score line at distances which, when added to the distance at which said perforation lines are spaced from said side score line, is equal to or greater than the height of one of said body portions.

10. An envelope capable of reuse as a folder for retaining therewithin loose materials and comprising a sheet of foldable material such as paper cut, scored, folded and glued to form a planar rectangular main body of predetermined height and width and bounded by three straight side score lines and a cut edge; an horizontal score line crossing said main body for dividing said main body into body portions of substantially equal height which are hingedly connected one to the other along said dividing score line and folded therealong to form the face and back of the envelope; right and left flap panel means extending vertically of said main body and hingedly connected thereto along right and left ones of said side score lines for folding leftwardly and rightwardly respectively into juxtaposition with said body portions and within the envelope formed thereby; a closure flap panel of predetermined height extending horizontally of and substantially coextensively with said main body and hingedly connected to an adjacent one of said body portions along the one of said side score lines remote from and parallel to said cut edge, said adjacent one of said body portions being that one which forms the face of the envelope, said closure flap panel having a free edge remote from said one side score line and forming a closure for the envelope; at least one line of perforations extending parallel to said one side score line and crossing said closure flap panel at a predetermined distance from said one side score line for facilitating separation of said closure flap panel into a reclosable flap portion adjoining the face of the envelope and a reinforcing strip portion adjacent said free edge, said line of perforations being of a predetermined length; and a linear cut line formed in and extending generally horizontally of a body portion remote from said closure flap panel and adjacent to said one body portion to which said closure flap panel is connected, said remote body portion forming the back of the envelope, said cut line being of such a predetermined length and so positioned relative to said dividing score line as to be spaced therefrom at a distance which, when added to the distance at which said perforation line is spaced from said side score line, is substantially the same as the height of one of said body portions.

11. An envelope as claimed in claim 10 wherein said cut line comprises two straight line portions converging away from said dividing score line and intersecting at a point which is medial the width of the body portion in which the cut line is formed.

12. An envelope as claimed in claim 10 wherein said cut line comprises a single arcuate line concave toward said dividing score line.

13. An envelope as claimed in claim 10 wherein said cut line extends from and joins a right terminal point and a left terminal point, said terminal points being spaced from adjacent ones of said side score lines at predetermined equal distances such that the width dimension between the terminal points is substantially equal to the length of said line of perforations.

14. An envelope as claimed in claim 10 further comprising two parallel lines of perforations formed in and crossing said closure flap for defining therebetween a removable zip tab portion.

15. An envelope as claimed in claim 10 wherein said right and left flap panel means have predetermined widths such that the sum of such widths is greater than the width of said main body.

16. An envelope as claimed in claim 10 further comprising liner means interposed between said body portions and said flap panel means for stiffening said envelope.

17. A suitably cut and scored blank adapted to be folded for forming a folded envelope and comprising a sheet of foldable material such as paper cut and scored for defining a planar rectangular main body of predetermined height and width and bounded by three straight side score lines and a cut edge; at least one dividing score line crossing said main body for dividing said main body into at least two body portions of substantially equal height which are hingedly connected one to the other along said score line; right and left flap panel means extending vertically of said main body and hingedly connected thereto along right and left ones of said side score lines for folding leftwardly and rightwardly respectively into juxtaposition with said body portions; a closure flap panel of predetermined height extending horizontally of and substantially coextensively with said main body and hingedly connected to an adjacent one of said body portions along the one of said side score lines remote from and parallel to said cut edge, said closure flap panel terminating in a straight cut flap edge parallel to said cut edge, said flap edge having a length greater than one half the width of said main body; and a linear cut line formed in and extending generally horizontally of a body portion remote from said closure flap panel and adjacent to said one body portion to which said closure flap panel is connected, said cut line comprising two straight line portions converging away from said dividing score line and intersecting at a point which is medial the width of the body portion in which the cut line is formed and being of such a predetermined length and so positioned relative to said dividing score line as to have a major portion of the length thereof spaced from said dividing score line at distances which, when added to the height of said closure flap panel, are greater than the height of one of said body portions.

18. An envelope for retaining therewithin loose materials and comprising a sheet of foldable material such as paper cut, scored, and folded to form a planar rectangular main body of predetermined height and width and bounded by three straight side score lines and a cut edge; an horizontal score line crossing said main body for dividing said main body into body portions of substantially equal height which are hingedly connected one to the other along said dividing score line and folded therealong to form the face and back of the envelope; right and left flap panel means extending vertically of said main body and hingedly connected thereto along right and left ones of said side score lines for folding leftwardly and rightwardly respectively into juxtaposition with said body portions and within the envelope formed thereby; a closure flap panel of predetermined height extending horizontally of and substantially coextensively with said main body and hingedly connected to an adjacent one of said body portions along the one of said side score lines remote from and parallel to said cut edge, said adjacent one of said body portions being that one which forms the face of the envelope, said closure flap panel forming a closure for the envelope and terminating in a straight linear cut flap edge parallel to said cut edge, said flap edge having a length greater than one half the width of said main body. ; and a linear cut line formed in and extending generally horizontally of a body portion remote from said closure flap panel and adjacent to said one body portion to which said closure flap panel is connected, said remote body portion forming the back of the envelope, said cut line comprising two straight line portions converging away from said dividing score line and intersecting at a point which is medial the width of the body portion in which the cut line is formed, said cut line being of such a predetermined length and so positioned relative to said dividing score line as to be spaced therefrom at a distance which, when added to the height of said closure flap panel is greater than the height of one of said body portions.

* * * * *